United States Patent [19]

Seko

[11] Patent Number: 4,775,088

[45] Date of Patent: Oct. 4, 1988

[54] INTERMITTENT WEB FEEDING APPARATUS

[75] Inventor: Kiyoshi Seko, Nagoya, Japan

[73] Assignee: Fuji Machinery Company, Ltd., Nagoya, Japan

[21] Appl. No.: 889,704

[22] Filed: Jul. 28, 1986

[30] Foreign Application Priority Data

Jul. 13, 1986 [JP] Japan ..... 61-139060

[51] Int. Cl.[4] ..... B65B 9/06; B65B 41/16; B65H 20/04; B65H 23/18

[52] U.S. Cl. ..... 226/172; 53/389; 53/552; 226/115; 226/121; 226/134; 242/75.45

[58] Field of Search ..... 226/109, 115, 121, 134, 226/172, 181, 187, 156, 157; 53/389, 551, 552, 451; 242/67.5, 75.45

[56] References Cited

U.S. PATENT DOCUMENTS

| | | | |
|---|---|---|---|
| 2,948,931 | 8/1960 | Smith | 226/172 X |
| 3,112,055 | 11/1963 | Hartley | 226/156 X |
| 3,635,386 | 1/1972 | Kallenberg | 226/157 X |
| 4,011,978 | 3/1977 | Lehmacher et al. | 226/156 X |
| 4,288,965 | 9/1981 | James | 53/451 |
| 4,691,499 | 9/1987 | Umeda et al. | 53/451 |

*Primary Examiner*—Stuart S. Levy
*Assistant Examiner*—Lynn M. Sohacki
*Attorney, Agent, or Firm*—Schwartz & Weinrieb

[57] ABSTRACT

An intermittent web feeding apparatus for intermittently feeding fixed length of a web of material during one cycle of a feeding operation by the cooperative operation of a pair of feed rollers for unwinding a web of material from a roll of web material and feeding the web of material to a web processing machine such as a bag-forming and packing machine, and for feeding the web of material to a processing position within the web processing machine, is disclosed. The intermittent web feeding apparatus is equipped with a single servomotor for driving the feed rollers through means of a first transmission mechanism, and the feeding units through means of a second transmission mechanism. The second transmission includes a one-way clutch for delaying the stoppage of the feeding units for a suitable period of time relative to the feed rollers so that the portion of the web of material extending between the feed rollers and the feeding units is kept in a moderately taut state when the web feeding operation is interrupted.

20 Claims, 3 Drawing Sheets

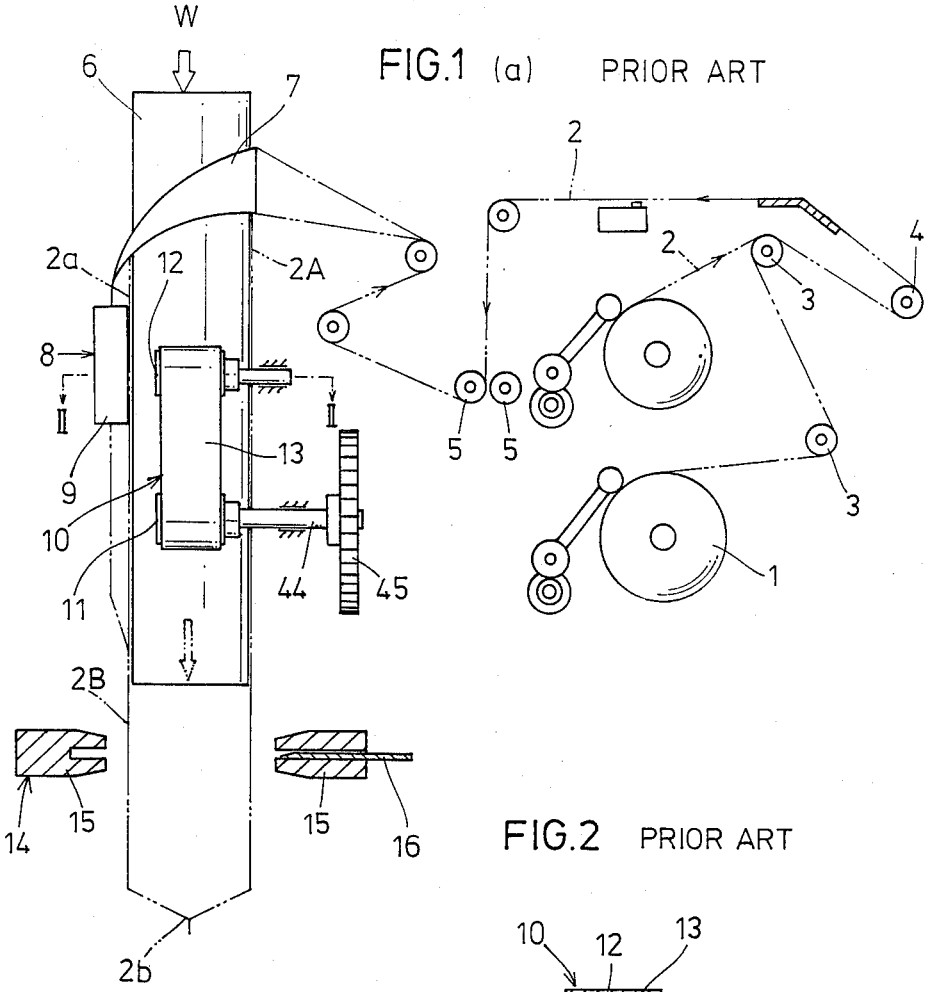
FIG.1 (a) PRIOR ART
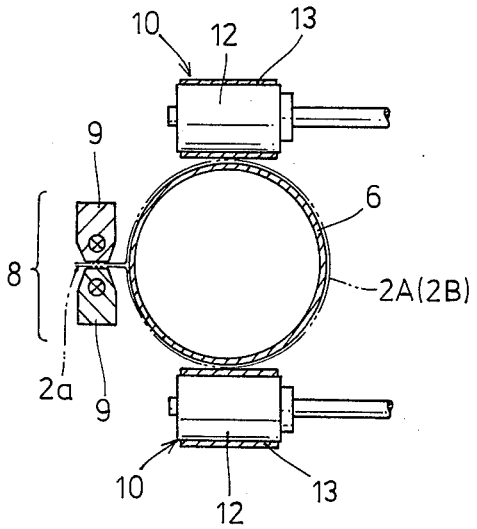
FIG.2 PRIOR ART

FIG.1 (b) PRIOR ART
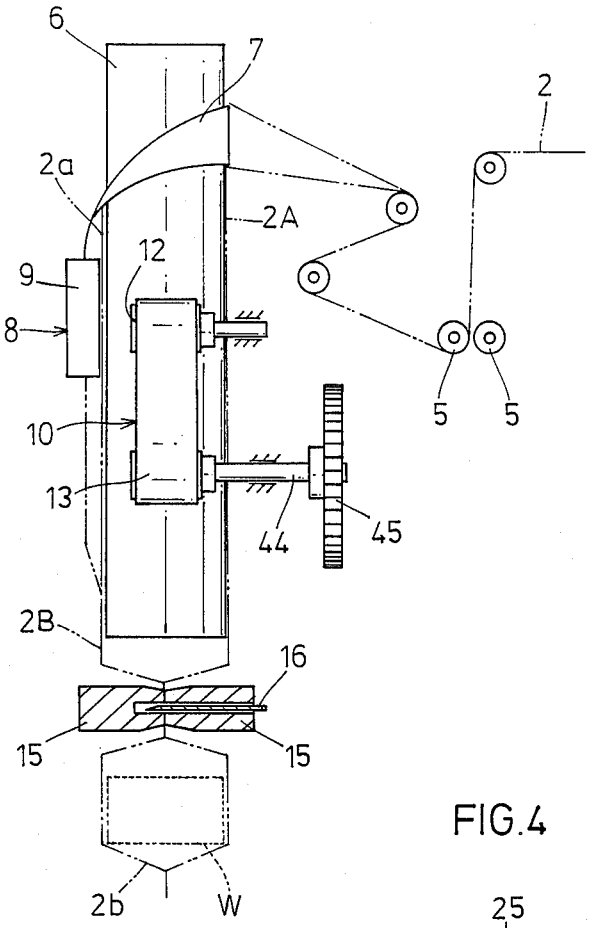
FIG.4
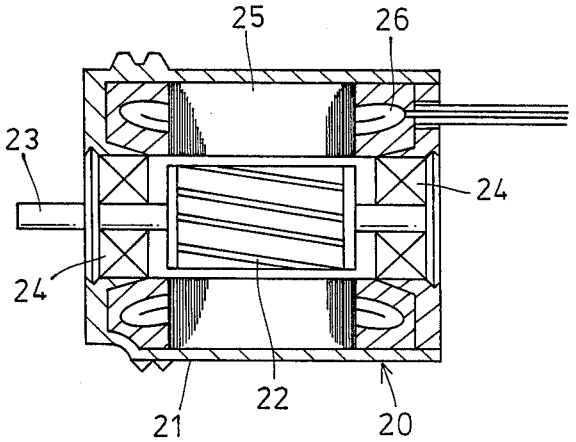

INTERMITTENT WEB FEEDING APPARATUS

BACKGROUND OF THE INVENTION

1. Field of the Invention

The present invention relates to an intermittent web feeding apparatus and, more specifically, to an intermittent web feeding apparatus employing a servomotor for intermittently feeding a fixed length of a continuous web of material drawn out from a roll of web material during one feeding cycle and which is capable of intermittently feeding the web under tensioned conditions at a high rate of feed speed.

2. Description of the Prior Art

Continuous webs, such as continuous thin films, of soft synthetic resins are widely used as packing material due to their excellent impermeability and flexibility. A bag forming and packing machine generally designated as a pillow packer is practically used as an automatic packing machine which packs articles in packing bags formed on such a web of material. Typically, this packing machine is of the vertical type capable of automatically carrying out a series of processes including intermittently feeding a web of material through means of a fixed package forming length during one feeding cycle, forming a bag with the web of material of the fixed package forming length, supplying an article in the bag, and sealing the bag.

The present invention provides an intermittent web feeding apparatus for such a vertical packing machine. In order to facilitate the understanding of the present invention, the general mode of the packing operation of the vertical packing machine and the mode of the intermittent web feeding operation for the vertical packing machine will be described with reference to FIGS. 1*a*, 1*b* and 2 prior to the description of the present invention.

A continuous web of material 2 unwound from a roll 1 of web material (one among two rolls 1 of web material is a preparatory roll of web material for the next use) travels via guide rollers 3 and 4 disposed at appropriate positions, respectively, and is fed by means of a pair of feed rollers 5. The feed rollers 5 rotate intermittently so as to feed the web of material 2 intermittently a fixed length during one feed cycle. A packing machine has a vertical guide tube 6 serving as a chute for feeding articles, and a pair of rotary feeding units 10 disposed upon opposite sides of the guide tube 6, respectively. The rotary feeding units 10 are positively driven intermittently in synchronism with the feed rollers 5 and at the same circumferential speed as that of the feed rollers by means of a driving mechanism which will be described later. The rotary feeding units 10 feed the web of material a fixed distance and form the web of material 2 into the shape of a bag. Preferably, each rotary feeding unit 10 is a belt conveyor comprising an upper pulley 12, a lower pulley 11 and an endless belt 13 extending between the upper pulley 12 and the lower pulley 11.

The web of material 2 unwound from the roll 1 of web material by means of the feed rollers 5 is folded into a tubular shape by means of a former 7 surrounding the upper portion of the guide tube 6. As the tubular web 2A is moved intermittently along the outer circumference of the guide tube 6 through a fixed distance corresponding to the packing length of the articles, the opposite side edges 2*a* of the tubular web 2A are heat-sealed by means of the heat-sealing members 9 of a center sealing device 8 disposed adjacent to the outer circumference of the guide tube 6 so as to form a packing tube 2B. Then, the packing tube 2B is moved downwardly along the guide tube 6 by means of the rotary feeding units 10 (FIG. 1*a*).

During the interruption of the intermittent feeding of the packing tube 2B, an article W to be packed is supplied from a hopper, not shown, through the guide tube 6 into the end-sealed portion 2*b* of the packing tube 2B. The lower end of the end-sealed portion 2*b* of the packing tube 2B has been previously sealed. Then, the packing tube 2B is moved further downwardly through by a fixed distance corresponding to the packing length of the articles along the guide tube 6, and then the heat-sealing members 15 and the cutting knife 16 of an end sealing device 14 are actuated so as to heat-seal the upper end of the end-sealed portion 2*b*, so that the article W is sealed in a pillow bag 2*c*. The same procedural cycle including unwinding the web of material 2 from the roll 1 of web material, intermittently feeding the web of material 2, forming the packing tube 2B, supplying the article W into the packing tube 2B, and end-sealing and cutting the end-sealed portion 2*b* is repeated for the intermittent bag-forming and packing operation.

In this vertical packing machine, the feed rollers 5 positively withdraw the web of material 2 from the roll 1 of web material, while the rotary feeding units 10 positively feed the packing tube 2B. The feed rollers 5 and the rotary feeding units 10 are operated synchronously for the intermittent feeding of the web of material 2 and the packing tube 2B. However, each time the intermittent feeding of the web of material 2 and the packing tube 2B is interrupted, the web of material 2 tends to slacken between the feed rollers 5 and the bag former 7. The slackening of the web of material 2 results in the zigzag movement of the web of material 2, which makes the smooth feeding of the web of material 2 impossible and causes deformation and irregularity in the packages resulting in the faulty sealing of the packages.

The applicant of the present invention previously proposed "A Web Tensioning Method" in Japanese Patent Application No. 59-77010, as a means for preventing the slackening of the web of material and for achieving regular intermittent feeding of the web of material, and applied the proposed method to a practical intermittent web feeding apparatus. This known intermittent web feeding apparatus combined with the above-mentioned vertical packing machine has a single general purpose motor for driving the transmission systems of the feed rollers and the packing tube feeding unit in unison, electromagnetic clutches provided in the transmission systems, and a one-way clutch interlocking one of the electromagnetic clutches and the packing tube feeding unit. In the starting mode, the revolving speed of the motor is controlled and the electromagnetic clutches are controlled so as to start the feeding rollers and the packing tube feeding unit simultaneously. In the stopping mode, since the one-way clutch is provided, the packing tube feeding unit is stopped with a delay after the feed rollers have been stopped, and thereby a moderate tension is applied to the web of material when the web feeding operation is interrupted.

This method proposed by the applicant of the present invention prevents the slackening of the web of material and always keeps the web of material tight under a moderate tension for smooth intermittent web feeding, and hence the intermittent web feeding apparatus employing this method is sufficiently capable of achieving a low-speed bag-forming and packing operation. However, since the response speed, namely, the speed of response to control signals provided by a control circuit, of the electromagnetic clutches in starting and stopping the feed rollers and the packing tube feeding unit is limited, this intermittent web feeding apparatus is incapable of achieving a high-speed intermittent web feeding operation, which has been agressively desired by the users. The employment of dog clutches instead of friction clutches will enhance the processing speed to some extent. However, since dog clutches produce shocks and noise when engaged or disengaged, thereby increasing the frequency of operational difficulties, and hence dog clutches are not desirable. When mechanical clutches regardless of type are employed, the operating speed of the apparatus is limited and the intermittent web feeding apparatus is unable to meet the requirements of the industry.

SUMMARY OF THE INVENTION

In view of the inherent disadvantages of the above-mentioned prior art, the present invention has been developed to resolve the problems inherent in the conventional intermittent web feeding apparatus. The present invention employs a servomotor, which is capable of quickly responding to control commands and of achieving instantaneous starting and stopping, as a means for driving both the feed rollers and the packing tube feeding unit of an intermittent web feeding apparatus so as to achieve the high-speed response control of the simultaneous starting of the feed rollers and the packing tube feeding unit and the delayed stopping of the packing tube feeding unit relative to the feed rollers.

OBJECT OF THE INVENTION

Accordingly, an object of the present invention is to provide an intermittent web feeding apparatus capable of preventing the slackening of the web of material between the feed rollers and the packing tube feeding unit during the interruption of feeding operation so that the web of material is always maintained in a moderately taut state, and which is capable of achieving a high-speed and smooth intermittent web feeding operation so that the efficiency, and hence the productivity, of the associated packing machine is improved.

BRIEF DESCRIPTION OF THE DRAWINGS

The above and other objects, features and advantages of the present invention will become more apparent from the following description of the preferred embodiment thereof taken in conjunction with the accompanying drawings, in which like reference characters designate like or similar parts throughout the several views, and wherein:

FIG. 1*a* is a schematic front elevation of a vertical bag-forming and packing machine as one of the representative machines using a continuous web of material, in which the bag-forming and packing machine is in the web feeding operation;

FIG. 1*b* is a schematic front elevation similar to FIG. 1*a*, in which the bag-forming and packing machine is in the end sealing operation and the web feeding operation is interrupted;

FIG. 2 is a sectional plan view taken on line II—II in FIG. 1*a*;

FIG. 4 is a longitudinal sectional view of a servomotor employed in the intermittent web feeding apparatus of FIG. 3.

DESCRIPTION OF THE PREFERRED EMBODIMENT

Figure 3:
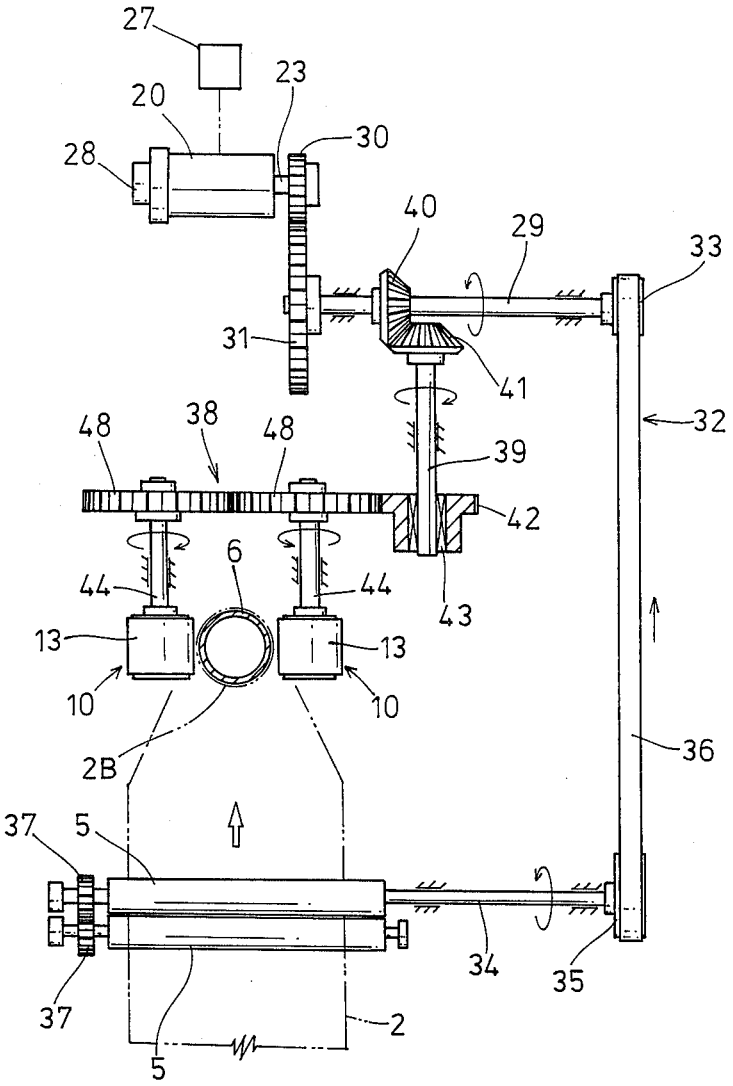
FIG. 3 is a schematic plan view of an intermittent web feeding apparatus, in a preferred embodiment, according to the present invention incorporated into the bag-forming and packing machine of FIG. 1*a*.

Referring to FIG. 3, a pair of feed rollers 5 for unwinding a web of material 2 from a roll of web material and feeding the web of material 2 to a bag-forming and packing machine, and a pair of rotary packing tube feeding units 10 are driven by means of a single servomotor 20, preferably, an AC servomotor. The rotative power of the servomotor 20 is transmitted through a first transmission mechanism 32 to the feed rollers 5 and through a second transmission mechanism 38 to the rotary packing tube feeding units 10.

The servomotor 20 is mounted on the frame of the bag-forming and packing machine. A pinion 30 fixed upon the output shaft 23 of the servomotor 20 is always in engagement with a gear 31 fixed upon a main shaft 29 journaled on the frame of the bag-forming and packing machine. The first transmission mechanism 32 of the belt-and-pulley system, and the second transmission mechanism 38 of the gear train system are interlocked with the main shaft 29.

The servomotor 20 is required to be capable of high fidelity to frequent positioning and speed regulating commands, and hence the servomotor 20 is required to be capable of high acceleration during starting and high deceleration during stopping. Accordingly, the servomotor 20 must be able to produce a large torque and the moment of inertia of the rotor must be small. Preferably, the servomotor 20 is an ordinary two-phase or three-phase AC induction servomotor meeting the above-mentioned requirements. As illustrated in FIG. 4, the servomotor 20 comprises the output shaft 23, a rotor 22 fixed upon the output shaft 23, a tubular housing 21, bearings 24 rotatably supporting the output shaft 23 within the tubular housing 21, a stator core 25 mounted within the tubular housing 21, and stator coils 26 wound around the stator core 25. In order to reduce the moment of inertia of the rotor 22 for quick responsiveness to control commands and for correct instantaneous starting and stopping, the diameter-to-length ratio of the rotor 22 is in the range of 1:2–4. Other characteristics of the servomotor 20 are the same as those inherent to AC servomotors, and hence the description thereof will be omitted.

The servomotor 20 is controlled by means of a controller 27. Control programs for controlling the bag-forming and packing machine for achieving a high-speed bag-forming and packing operation are previously stored in the controller 27. Incidentally, the packing speed of a high-speed bag-forming and packing machine is, for example, 100 to 120 packages per minute. The starting time necessary for feeding the web of material 2 and the packing tube 2B through a distance corresponding to the packing length, and the stopping time necessary for end-sealing and cutting the packing tube 2B are precisely set and control commands for starting and stopping the feeding operation so as to meet the starting time and the stopping time are alternately provided. A rotary encoder 28 is connected to the servomotor 20 so as to detect and monitor the operating conditions including the revolving speed of the servomotor 20.

The first transmission mechanism 32 comprises a pulley 33 fixed upon one end of the main shaft 29, a pulley 35 fixed upon the shaft 34 of one of the feed rollers 5, an endless belt 36 extending between the pulleys 33 and 35, and gears 37 fixed upon the shafts of the feed rollers 5 and engaging each other. The power of the servomotor 20 is transmitted through means of the first transmission mechanism 32 to the feed rollers 5 so as to positively rotate the feed rollers 5.

The second transmission mechanism 38 comprises a bevel gear 40 fixed upon the main shaft 29, a bevel gear 41 fixed upon one end of a transmission shaft 39 disposed perpendicular to the main shaft 29 and engaging the bevel gear 40, a one-way clutch 43 mounted upon the other end of the transmission shaft 39, a gear 42 fitted upon the one-way clutch 43, a gear 48 fixed upon the shaft 44 of the pulley 11 of one of the packing tube feeding units 10 and engaging the gear 42, and a gear 48 fixed upon the shaft 44 of the pulley 12 of the other packing tube feeding unit 10 and engaging the former gear 48. The one-way clutch 43 allows the gear 42, and hence the packing tube feeding units 10, to rotate by inertia after the transmission shaft 39 has been stopped. That is, while the transmission shaft 39 is rotated in the direction of the arrow, the one-way clutch 43 is engaged so as to positively rotate the gear 42 and, when the transmission shaft 39 is stopped, the one-way clutch is disengaged so as to allow the gear 42 to rotate by inertia for a short period of time in the direction of the arrow. Thus, the packing tube feeding units 10 are able to rotate slightly in the feeding direction after the transmission shaft 39 has been stopped.

Thus, the feed rollers 5 and the packing tube feeding units 10 are started simultaneously when the servomotor 20 is started, while the packing tube feeding units 10 stop with a time lag after the servomotor 20, and hence the feed rollers 5, has been stopped. When a starting command is provided by means of the controller 27, the servomotor 20 is actuated so as to rotate the main shaft 29 in a predetermined direction at a reduced speed of revolution defined by means of the reduction ratio between the pinion 30 and the gear 31. The main shaft 29 drives the first transmission mechanism 32 and the second transmission mechanism 38 simultaneously. Consequently, the feed rollers 5 and the packing tube feeding units 10 are rotated synchronously through means of the first transmission mechanism 32 and the second transmission mechanism 38, respectively. The first transmission mechanism 32 and the second transmission mechanism 38 are designed so that the circumferential speed of the feed rollers 5 and that of the endless belts 13 of the packing tube feeding units 10 are the same. Thus, the web feeding operation and the packing tube feeding operation are started simultaneously so as to feed the web of material 2 and the packing tube 2B in a uniformly taut state.

When a STOP command is provided by means of the controller 27, the servomotor 20 is stopped instantly, and thereby the main shaft 29 is also stopped instantly. Consequently, the feed rollers 5 are stopped instantly. On the other hand, although the transmission shaft 39 of the second transmission mechanism 38 is stopped instantly when the servomotor 20 is stopped, the one-way clutch 43 allows the gear 42 to stop with a time delay after slightly rotating by means of inertia in the direction of the arrow. Accordingly, the packing tube feeding units 10 are allowed to rotate slightly in the feeding direction after the servomotor 20 has been stopped. Thus, the first transmission mechanism 32 and the feed rollers 5 are stopped instantly upon the stoppage of the servomotor 20 so as to immediately stop feeding the web of material 2, while the pulleys 11 and 12 of the packing tube feeding units 10 come to a stop with a time delay after the servomotor 20 has been stopped. Accordingly, a moderate amount of tension is applied to the web of material 2 and the portion of the packing tube 2B extending between the feed rollers 5 and the packing tube feeding units 10 so as to prevent the slackening of the web of material 2 and the portion of the packing tube 2B interposed between the feed rollers 5 and the packing tube feeding units 10. While the feeding of the web of material 2 and the packing tube 2B is interrupted, the end sealing device 14 is actuated so as to seal the packing tube 2B. Thus, one cycle of the bag-forming and packing operation is completed and the next cycle of the same process is ready to be started.

Upon the completion of the bag-forming and packing operation, the controller 27 provides a START command so as to restart the servomotor 20. Then, the first transmission mechanism 32 and the second transmission mechanism 38 are simultaneously started through means of the main shaft 29. Consequently, the feed rollers 5 and the packing tube feeding units 10 are started simultaneously. Then, after a fixed period of time, a STOP command is provided so as to stop the servomotor 20. Upon the stoppage of the servomotor 20, the feed rollers 5 are stopped instantly, while the pulleys 11 and 12 of the packing tube feeding units 10 are stopped with a time delay. Thereafter, the servomotor 20 is started and stopped alternately, and thereby the feed rollers 5 and the pulleys 11 and 12 of the packing tube feeding units 10 are started instantly and simultaneously, while the feed rollers 5 are stopped instantly and the pulleys 11 and 12 of the packing tube feeding units 10 are stopped with a time delay accordingly. Thus, the web of material 2 and the packing tube 2B are always fed intermittently in a moderately taut state so as to feed the packing tube 2B intermittently by means of a fixed length during one cycle of the feeding operation. The web feeding operation of the intermittent web feeding apparatus and the bag-forming and packing operation of the bag-forming and packing machine are alternately effected so as to achieve the packaging of articles W at a high rate of speed.

In modifications of the present invention, both the transmission mechanisms 32 and 38 may be of the belt-and pulley type or the chain-and-sprocket type, and the output shaft 23 of the servomotor 20 may project from the opposite axial ends of the tubular frame 21, respectively, with the first and second transmission mechanisms being connected to the opposite ends of the output shaft 23, respectively. The one-way clutch 43 incorporated into the second transmission mechanism for delaying the stopping of the packing tube feeding units may be replaced by any other suitable means.

The present invention is applicable not only to packing machines but also the present invention is applicable to other machines, such as printing machines and web of material processing machines, in which a web needs to be fed intermittently.

As is apparent from what has been described hereinbefore, since the intermittent web feeding apparatus according to the present invention employs a single servomotor which is capable of quick response to control commands and which is also capable of smooth and instantaneous starting and stopping as a means for driving both the feed rollers and the packing tube feeding units, the feed rollers and the packing tube feeding units can be started synchronously through the first and second transmission mechanisms interlocked with the servomotor. Furthermore, since the second transmission for transmitting the power of the servomotor to the packing tube feeding units includes a one-way clutch, the stopping of the packing tube feeding units is delayed in time relative to the stopping of the servomotor, and hence the feed rollers, and thereby the web of material and the packing tube portion extending between the feed rollers and the packing tube feeding units are kept in a moderately taut state when the intermittent web feeding operation is interrupted. Accordingly, the intermittent web feeding apparatus enables the smooth and high-speed operation of the associated machine, and thereby the operating efficiency of the machine is improved.

The present invention has been described as employing an AC servomotor. However, since the present invention employs a servomotor which exhibits excellent instantaneous starting and stopping characteristics, a DC servomotor may be used instead of the AC servomotor, provided that the DC servomotor has the same excellent starting and stopping characteristics. However, the AC servomotor is more preferable than the DC servomotor, because the AC servomotor has inherent characteristics that do not require feedback control and hence the AC servomotor can be controlled by means of a simple control circuit. Furthermore, the AC servomotor requires less maintenance work than the DC servomotor.

Although the invention has been described in its preferred form with a certain degree of particularity, it is to be understood that many variations and changes are possible in the invention without departing from the scope and spirit thereof.

What is claimed is:

1. Intermittent web feeding apparatus for intermittently feeding predetermined length portions of web material during successive cycles of the intermittent feed operation of said intermittent web feeding apparatus, comprising:

a supply roll of said web material;

web feeding rolls for withdrawing said web material from said supply roll and forwarding said withdrawn web material;

means for advancing said web material from said web feeding rolls and forming said web material into a product;

servomotor drive means for driving both said web feeding rolls and said product forming means;

controller means, operatively connected to said servomotor drive means, containing control programs stored therein for starting and stopping said servomotor drive means at predetermined times in order to determine said successive intermittent feed cycles;

first transmission means for driving said web feeding rolls at a first predetermined rate of speed;

second transmission means for driving said web product forming means at a second predetermined rate of speed;

transmission shaft means for interconnecting said servomotor drive means to said first and second transmission means for transmitting drive from said servomotor drive means to said first and second transmission means; and one-way transmission means interposed between said transmission shaft means and said web product forming means for permitting said web product forming means to continue to rotate for a predetermined period of time after said controller means has stopped said servomotor drive means, and therefore said transmission shaft means and said web feeding rolls, whereby said web product forming means retains the portion of said web material, interposed between said web feeding rolls and said web product forming means, in a tensioned state.

2. An intermittent web feeding apparatus as recited in claim 1, wherein said servomotor is an AC servomotor.

3. An intermittent web feeding apparatus as recited in claim 1, wherein said servomotor is a DC servomotor.

4. An intermittent web feeding apparatus as recited in claim 1, wherein said first transmission mechanism is a belt-and-pulley mechanism.

5. An intermittent web feeding mechanism as recited in claim 1, wherein said second transmission mechanism is a gear train.

6. An intermittent web feeding apparatus as recited in claim 1, wherein said one-way means is a one-way clutch.

7. Apparatus as set forth in claim 1, wherein:

said transmission shaft means comprises a first transmission shaft having one end thereof drivingly connected to said servomotor drive means and the other end thereof drivingly connected to said first transmission means, and including a first gear mounted upon said first transmission shaft; and said transmission shaft means further comprises a second transmission shaft having a second gear mounted upon one end thereof for engagement with said first gear of said first transmission shaft, and having the other end of said second transmission shaft drivingly connected to said one-way transmission means.

8. Apparatus as set forth in claim 7, wherein said first transmission means comprises:

a first pulley operatively mounted upon said other end of said first transmission shaft;

a second pulley operatively connected to one of said web feeding rolls; and an endless pulley belt drivingly extending between said first and second pulleys.

9. Apparatus as set forth in claim 8, further comprising:

first gear means mounted upon one end of another one of said web feeding rolls; and second gear means mounted upon one end of said one of said web feeding rolls and operatively engaged with said first gear means for transmitting operative drive from said second pulley to said another one of said web feeding rolls.

10. Apparatus as set forth in claim 7, wherein:

said first and second transmission shafts are disposed substantially perpendicular with respect to each other.

11. Apparatus as set forth in claim 1, wherein said second transmission means comprises:

first gear means operatively engaged with said one-way transmission means; and second gear means mounted upon said product forming means and interengaged with said first gear means.

12. Apparatus as set forth in claim 1, wherein:
said web of material is packaging material within which articles are to be packaged.

13. Intermittent web feeding apparatus for intermittently feeding predetermined length portions of a web of packaging material during successive cycles of the intermittent feed operation of said intermittent web feeding apparatus, comprising:
a supply roll of said web packaging material;
web feeding rolls for withdrawing said web of packaging material from said supply roll and forwarding said withdrawn web of packaging material;
tube forming means for advancing said web of packaging material from said web feeding rolls and forming said web of packaging material into tubular envelopes within which articles are to be packaged;
servomotor drive means for driving both said web feeding rolls and said tube forming means;
controller means, operatively connected to said servomotor drive means, containing control programs stored therein for starting and stopping said servomotor drive means at predetermined times in order to determine said successive intermittent feed cycles;
first transmission means for driving said web feeding rolls at a first predetermined rate of speed;
second transmission means for driving said tube forming means at a second predetermined rate of speed;
transmission shaft means for interconnecting said servomotor drive means to said first and second transmission means for transmitting drive from said servomotor drive means to said first and second transmission means; and
one-way transmssion means interposed between said transmission shaft means and said tube forming means for permitting said tube forming means to continue to rotate for a predetermined period of time after said controller means has stopped said servomotor drive means, and therefore said transmission shaft means and said web feeding rolls, whereby said tube forming means retains the portion of said web material, interposed between said web feeding rolls and said tube forming means, in a tensioned state.

14. Apparatus as set forth in claim 13, wherein:
said servomotor drive means comprises an AC servomotor.

15. Apparatus as set forth in claim 13, wherein:
said one-way transmission means comprises a one-way clutch.

16. Apparatus as set forth in claim 13, wherein:
said transmission shaft means comprises a first transmission shaft having one end thereof drivingly connected to said servomotor drive means and the other end thereof drivingly connected to said first transmission means, and including a first gear mounted upon said first transmission shaft; and
said transmission shaft means further comprises a second transmission shaft having a second gear mounted upon one end thereof for engagement with said first gear of said first transmission shaft, and having the other end of said second transmission shaft drivingly connected to said one-way transmission means.

17. Apparatus as set forth in claim 16, wherein said first transmission means comprises:
a first pulley operatively mounted upon said other end of said first transmission shaft;
a second pulley operatively connected to one of said web feeding rolls; and
an endless pulley belt drivingly extending between said first and second pulleys.

18. Apparatus as set forth in claim 17, further comprising:
first gear means mounted upon one end of another one of said web feeding rolls; and
second gear means mounted upon one end of said one of said web feeding rolls and operatively engaged with said first gear means for transmitting operative drive from said second pulley to said another one of said web feeding rolls.

19. Apparatus as set forth in claim 16, wherein:
said first and second transmission shafts are disposed substantially perpendicular with respect to each other.

20. Apparatus as set forth in claim 13, wherein said second transmission means comprises:
first gear means operatively engaged with said one-way transmission means; and
second gear means mounted upon said tube forming means and interengaged with said first gear means.

* * * * *